US006971129B2

(12) United States Patent
Wootten, Jr. et al.

(10) Patent No.: US 6,971,129 B2
(45) Date of Patent: Dec. 6, 2005

(54) ADJUSTABLE BED SKIRT

(75) Inventors: Gerald E. Wootten, Jr., Cullman, AL (US); Kenneth L. Wilson, Naperville, IL (US)

(73) Assignee: Homtex, Inc., Vinemont, AL (US)

( * ) Notice: Subject to any disclaimer, the term of this patent is extended or adjusted under 35 U.S.C. 154(b) by 186 days.

(21) Appl. No.: 10/216,380

(22) Filed: Aug. 12, 2002

(65) Prior Publication Data

US 2003/0028965 A1 Feb. 13, 2003

Related U.S. Application Data

(60) Provisional application No. 60/311,105, filed on Aug. 10, 2001.

(51) Int. Cl.[7] ..... A47G 9/04
(52) U.S. Cl. ..... 5/493; 5/482
(58) Field of Search ..... 5/482, 493, 922, 5/923

(56) References Cited

U.S. PATENT DOCUMENTS

| | | | | |
|---|---|---|---|---|
| 2,619,658 A | * | 12/1952 | Gardiner | 5/493 |
| 4,141,097 A | | 2/1979 | Levinsohn et al. | |
| 4,587,683 A | * | 5/1986 | Gardiner | 5/493 |
| 4,807,316 A | | 2/1989 | Whipple | |
| 4,897,891 A | | 2/1990 | Kallman et al. | |
| D314,304 S | | 2/1991 | Levine | |
| 5,086,531 A | | 2/1992 | Carlos | |
| D339,495 S | | 9/1993 | Murray | |
| 5,271,112 A | | 12/1993 | Bible et al. | |
| 5,621,931 A | * | 4/1997 | Hamilton | 5/493 |
| 5,638,562 A | | 6/1997 | Masoncup | |
| 5,715,553 A | | 2/1998 | Baron et al. | |
| 5,733,397 A | * | 3/1998 | McDaniel | 156/66 |
| 5,749,110 A | | 5/1998 | Gamble et al. | |
| 5,946,750 A | * | 9/1999 | Shiu | 5/502 |
| 5,966,758 A | | 10/1999 | Karam | |
| 6,119,290 A | * | 9/2000 | Masoncup | 5/493 |
| 6,151,731 A | | 11/2000 | Saparow | |
| 6,598,249 B2 | * | 7/2003 | Pajanacci et al. | 5/493 |

* cited by examiner

*Primary Examiner*—Michael Trettel
*Assistant Examiner*—Fredrick Conley
(74) *Attorney, Agent, or Firm*—Dykema Gossett PLLC

(57) ABSTRACT

An adjustable bed skirt, for use with a bed having a mattress and a box spring, includes side panels having a non-slip portion, and end panels also including a non-slip portion. By inserting the non-slip portion of each side panel and each end panel between the mattress and the box spring, the side and end panels are retained in position so that the remaining non-inserted portion of each of the side and end panels hangs adjacent the box spring and forms a bed skirt thereon. Caps including a non-slip portion may also be inserted between the mattress and the box spring, adjacent edges of the box spring, to hide any gaps between edges of the side and end panels. The bed skirt may also be used with a bed having a mattress placed on a frame, and supported between the mattress and the frame.

18 Claims, 2 Drawing Sheets

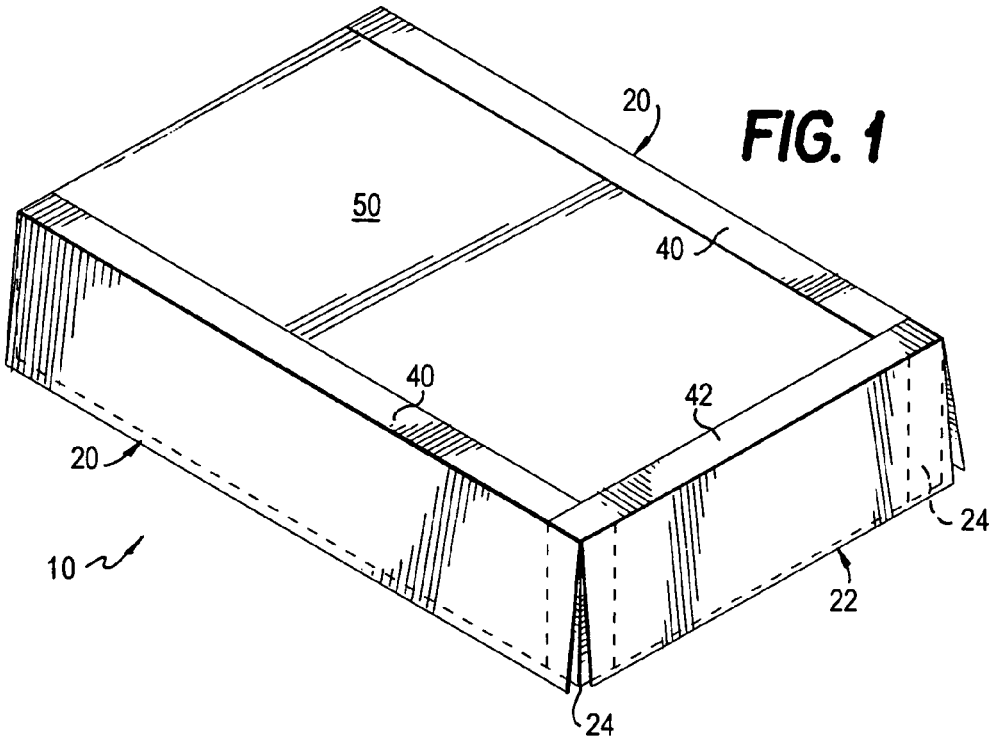
FIG. 1
FIG. 2
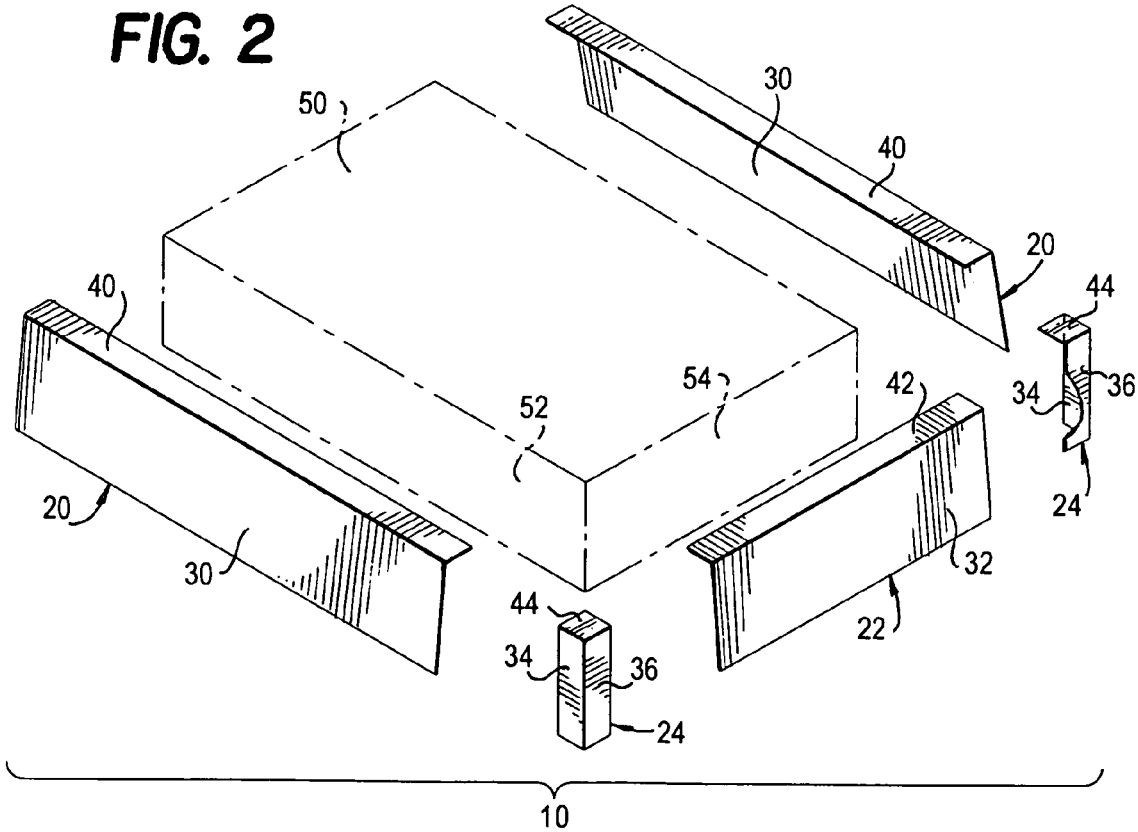

ADJUSTABLE BED SKIRT

RELATED APPLICATIONS

The present application claims the benefit of priority to Provisional Application Ser. No. 60/311,105, filed Aug. 10, 2001.

BACKGROUND OF INVENTION a. Field of Invention

The present invention relates generally to bed skirts, and more particularly to an adjustable bed skirt that can be used with beds of varying heights, and placed on a box spring of a bed without removal of a mattress.

b. Description of Related Art

Bed skirts commonly known in the art have a single central platform panel that is the size or shape of a standard mattress. The central platform panel has three or four side panels hanging perpendicular to the central platform panel, and attached at the outer edges thereof. The central platform panel lies flat on the top of a box spring, and the side panels hang over the edge of the box spring and essentially cover it from exposure.

Generally, bed skirts are placed on top of the box spring between the box spring and the top mattress of a mattress set. It is usually burdensome to place such bed skirts between the box spring and the top mattress because the top mattress has to be removed from atop the box spring. The bed skirt is then fit onto the box spring and the top mattress is replaced atop the box spring. Often, when the top mattress is being placed on top of the box spring, the bed skirt can shift in place, thus requiring the fit to be readjusted with the top mattress still resting on the box spring.

Presently, bed skirts are made of specific nominal lengths associated with average bed and mattress heights. For a bed that is lower or higher than the average bed height, most bed skirts made of nominal sizes are either too long (if the height of the bed is shorter than average) or too short (if the height of the bed is taller than average.)

SUMMARY OF INVENTION

The present invention solves the problems and overcomes the drawbacks and disadvantages of prior art bed skirts by providing a bed skirt which is adjustable to fit beds of different heights.

Another aspect of the present invention is to provide a bed skirt that is easily assembled onto a mattress set without any mattresses having to be removed.

In order to achieve the above-identified objectives, the present invention provides an adjustable bed skirt for use with a bed having a mattress and one or more box springs. The bed skirt includes one or more side panels having a non-slip portion, and one or more end panels having a non-slip portion. The non-slip portion of each of the side and end panels can be inserted between the mattress and the box spring and retained therein so that the remaining non-inserted portion of each of the side and end panels hangs adjacent the box spring and forms a bed skirt thereon. The bed skirt further includes one or more caps having a non-slip portion. The non-slip portion of each cap is inserted between the mattress and the box spring adjacent edges thereof, and is retained therein so that the remaining portion of each cap hangs adjacent the box spring and forms the bed skirt thereon. Each cap is disposed adjacent either inner surfaces of the side and end panels, or outer surfaces of the side and end panels.

The present invention also provides an adjustable bed skirt for use with a bed having at least one mattress on a frame. The bed skirt may include side panels including a non-slip portion, and end panels including a non-slip portion. The non-slip portion of each side panel and each end panel is capable of being inserted between the mattress and the frame and retained therein so that the remaining non-inserted portion of each side panel and each end panel hangs adjacent the frame and forms the bed skirt thereon. The bed skirt also includes caps having a non-slip portion. The non-slip portion of each cap is capable of being inserted between the mattress and the frame adjacent edges thereof and retained therein so that the remaining portion of each cap hangs adjacent the frame and forms the bed skirt thereon. Each cap may be disposed adjacent either inner surfaces of the side and end panels, or outer surfaces of the side and end panels.

The present invention yet further provides a method for placing an adjustable bed skirt on a bed having a mattress and a box spring. The method includes the steps of inserting a non-slip portion of a side panel between the mattress and the box spring adjacent a side of the box spring, and inserting a non-slip portion of an end panel between the mattress and the box spring adjacent another side of the box spring. The remaining non-inserted portion of each of the side and end panels hangs adjacent the box spring and forms a bed skirt thereon. The method also includes the step of inserting a non-slip portion of a cap between the mattress and the box spring adjacent an edge of the box spring, whereby the remaining non-inserted portion of each cap hangs adjacent the box spring and forms the bed skirt thereon. For the method described above, each cap may be inserted between the mattress and the box spring adjacent either inner surfaces of the side and end panels, or outer surfaces of the side and end panels.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings:

FIG. 1 is a perspective view of the adjustable bed skirt according to the present invention fitted on a box spring;

FIG. 2 is an exploded view of the adjustable bed skirt of FIG. 1 shown on a box spring.

DETAILED DESCRIPTION OF THE PREFERRED EMBODIMENT

Figure 3:
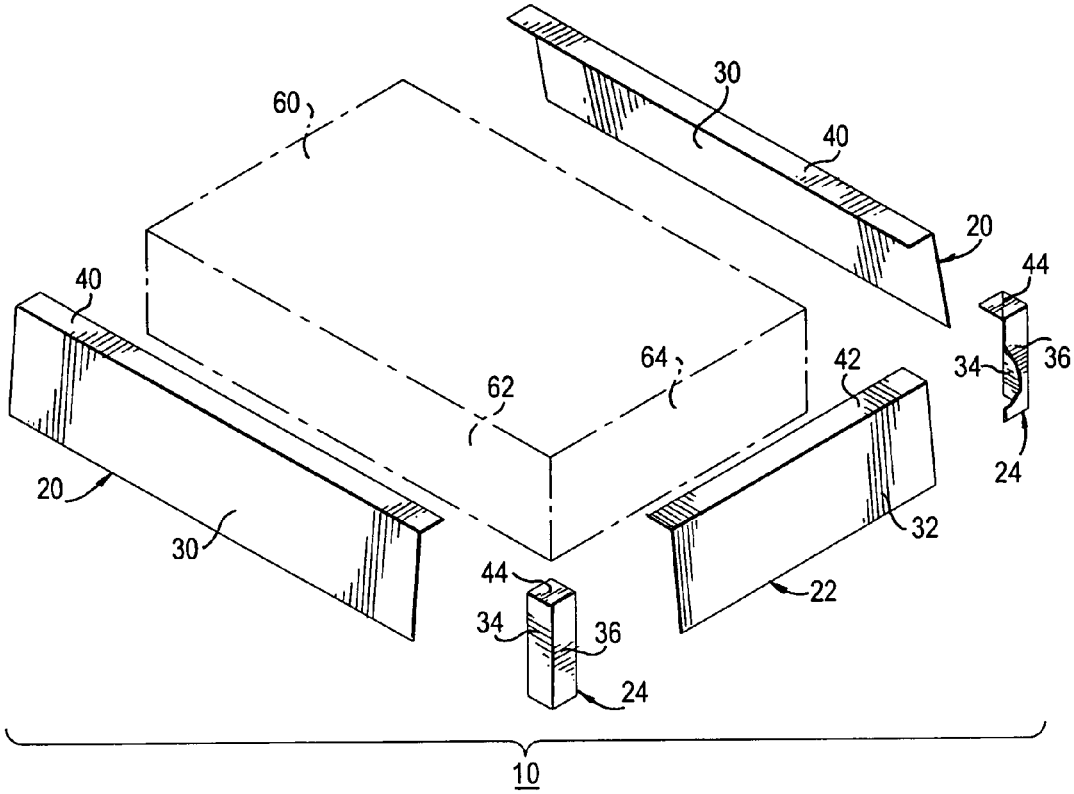
FIG. 3 is an exploded view of the adjustable bed skirt of FIG. 1 shown on a bed frame.

Referring now to the drawings wherein like reference numerals designate corresponding parts throughout the several views, FIG. 1 illustrates a perspective view of the adjustable bed skirt according to the present invention, generally designated 10.

Adjustable bed skirt 10 has a plurality of separate panels 20, 22 wherein the upper non-slip flap 40, 42 of each separate panel 20, 22, respectively, is placed between the mattress (not shown) and box spring 50 on a bed.

In the exemplary embodiment shown in FIG. 1, bed skirt 10 has two side panels 20 and an end panel 22. Two caps or inserts 24 may be placed where the edges of side panels 20 and end panel 22 meet, thereby filling any gap created between the edges of side panels 20 and end panel 22.

Each of the non-slip flaps 40, 42 may be made of a non-slip conventional material so as to prevent panels 20, 22 from slipping out of placement between box spring 50 and the mattress placed thereon.

An exploded view of the separate pieces of bed skirt 10 are shown in FIG. 2. The upper, non-slip flap 40 of each side panel 20 may be placed on box spring 50 so that non-slip flap 40 rests parallel with the top of box spring 50, and the lower remainder portion of each side panel 20 hangs over sides 52 of box spring 50 where is covers the respective side 52 from view.

Likewise, the upper non-slip flap 42 of end panel 22 may also be placed on box spring 50 so that non-slip flap 42 rests parallel with the top of box spring 50, and the lower remainder portion of end panel 22 hangs over sides 54 of box spring 50 where it covers end 54 of box spring 50 from view. It is apparent that if needed, an additional end panel 22 may be placed on the opposite side of box spring 50, opposite to the exemplary embodiment shown in FIG. 2.

The inserts or caps 24 may be attached to box spring 50 in a similar fashion as each of the side and end panels 20, 22. Specifically, cap 24 may include a non-slip flap 44 that is inserted onto the corner of box spring 50 below side panels 20 and end panel 22. However, for an alternative look, it is foreseeable the cap 24 can be located on top of side panels 20 and end panel 22.

Each cap 24 may also include two lower or hanging portions 34, 36 that fill in the gap created where the edges of side panels 20 meet with end panel 22.

The draped height of each panel 20, 22 and caps 24 may be adjusted by the amount of non-slip flap that is placed between the mattress and box spring of a bed. For example, the more non-slip flap 40, 42, 44 that is placed between the mattress and box spring 50, the shorter the bed skirt 10. Alternatively, the less non-slip flap 40, 42, 44 that is placed between the mattress and box spring 50, the longer the bed skirt 10 is.

In an alternative embodiment of the present invention, instead of being placed between a mattress and a box spring, bed skirt 10 may be placed below a mattress in a bed having a mattress resting on a frame, and retained between the mattress and the frame. For example, referring to FIG. 3, in a conventional bed having a curved or flat frame 60, the upper non-slip flap 40 of each side panel 20 may be placed on frame 60 so that non-slip flap 40 rests parallel with the top of frame 60, and the lower remainder portion of each side panel 20 hangs over sides 62 of frame 60 where it covers sides 62 from view. Likewise, the upper non-slip flap 42 of end panel 22 may also be placed on frame 60 so that non-slip flap 42 rests parallel with the top of frame 60, and the lower remainder portion of end panel 22 hangs over sides 64 of frame 60 where it covers side 64 of frame 60 from view. It is apparent that if needed, an additional end panel 22 may be placed on the opposite side of frame 60, opposite to the exemplary embodiment shown in FIG. 3.

After fitting of panels 20 and 22, the inserts or caps 24 may be attached to frame 60 in a similar fashion as each of the side and end panels 20, 22. Specifically, cap 24 may include a non-slip flap 44 that is inserted onto the corner of frame 60 below side panels 20 and end panel 22. However, for an alternative look, it is foreseeable the cap 24 can be located on top of side panels 20 and end panel 22.

It should be noted that the term "frame" used to identify frame 60 of FIG. 3 designates a general structure on which a mattress may rest, and may include any such general "frame" structure as would be apparent to a skilled artisan.

It is apparent that although a single mattress and box spring 50 were referred to throughout the disclosure, a plurality of mattresses and a plurality of box springs on a single bed may also be used with adjustable bed skirt 10 of the present invention. It is also apparent that since bed skirt 10 is comprised of an ensemble of separate pieces, a central platform is not needed and each piece is easily slipped between the mattress and box spring without having to remove the top mattress to place the bed skirt.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A bed skirt having an adjustable nominal hanging length for use with a bed having at least one mattress and box-spring, said bed skirt comprising:

at least one separate side panel including a non-slip portion and a hanging portion, said non-slip portion being formed as an integral extension of said hanging portion and being insertable and retainable between the mattress and the box-spring at a plurality of locations to cover a first surface area of a generally horizontal surface of the box-spring and to enable adjustment of the hanging length of said hanging portion, said non-slip portion of said side panel and said hanging portion have substantially the same fabric thickness, and said non-slip portion of said side panel being retainable between the mattress and the box-spring only by means of a fabric interaction between a top surface of said non-slip portion of said side panel and the mattress and between a bottom surface of said non-slip portion of said side panel and the box-spring; and at least one separate end panel including a non-slip portion and a hanging portion, said non-slip portion of said end panel being formed as an integral extension of said hanging portion of said end panel and being insertable and retainable between the mattress and the box-spring at a plurality of locations to cover a second surface area of the generally horizontal surface of the box-spring and to enable adjustment of the hanging length of said hanging portion of said end panel, said non-slip portion of said end panel and said hanging portion of said end panel have substantially the same fabric thickness, and said non-slip portion of said end panel being retainable between the mattress and the box-spring only by means of a fabric interaction between a top surface of said non-slip portion of said end panel and the mattress and between a bottom surface of said non-slip portion of said end panel and the box-spring, wherein when said non-slip portion of each side panel and each end panel is inserted between the mattress and the box-spring and retained therein, the first and second surface areas being substantially different from each other such that the first surface area does not substantially overlap the second surface area, the combined surface areas of the first and second surface areas is less than the total surface area of the generally horizontal surface, and said hanging portion of each side panel and each end panel hangs adjacent the box-spring and forms said bed skirt thereon, and wherein said hanging length being adjustable by shifting said non-slip portions of said side and end panels relative to a top surface of the box-spring.

2. A bed skirt having an adjustable nominal hanging length according to claim 1, further comprising:

at least one separate cap including a non-slip portion and a hanging portion, said non-slip portion of said cap being formed as an extension of said hanging portion of said cap and being insertable between the mattress and the box-spring to cover a third surface area of the generally horizontal surface of the box-spring, wherein when said non-slip portion of each cap is inserted between the mattress and the box-spring and retained therein, the first and second surface areas being substantially different from the third surface area such that the first and second surface areas overlap the third surface area and the surface area of each of the first and second surface areas is greater than the surface area of the third surface area, and said hanging portion of each cap hangs adjacent the box-spring and forms said bed skirt thereon.

3. A bed skirt having an adjustable nominal hanging length according to claim 2, each cap being disposed adjacent one of:

inner surfaces of said side panel and said end panel, and outer surfaces of said side panel and said end panel.

4. A bed skirt having an adjustable hanging length according to claim 1, further comprising:

at least one cap including a non-slip portion, wherein said non-slip portion of each cap capable of being insertable between the mattress and the box-spring adjacent edges thereof and retained therein so that the remaining portion of each cap hangs adjacent the box-spring and forms said bed skirt thereon.

5. A bed skirt having an adjustable nominal hanging length according to claim 1, wherein said non-slip and hanging portions of at least one of said side panel and said end panel being formed of a same material.

6. A bed skirt having an adjustable nominal hanging length to claim 1, wherein said non-slip and hanging portions of at least one of said side panel and said end panel being formed of different materials.

7. A method for placing a bed skirt having an adjustable nominal hanging length on a bed having at least one mattress and a box-spring, said method comprising the steps of:

inserting and retaining a non-slip portion of at least one side panel including said non-slip portion and a hanging portion between the mattress and the box-spring at a plurality of locations to cover a first surface area of a generally horizontal surface of the box-spring and to enable adjustment of the hanging length of said hanging portion, said non-slip portion of said side panel being formed as an integral extension of said hanging portion, said non-slip portion of said side panel and said hanging portion have substantially the same fabric thickness, and said non-slip portion of said side panel being retainable between the mattress and the box-spring only by means of a fabric interaction between a top surface of said non-slip portion of said side panel and the mattress and between a bottom surface of said non-slip portion of said side panel and the box-spring; and inserting and retaining a non-slip portion of at least one end panel including said non-slip portion for said end panel and a hanging portion for said end panel between the mattress and the box-spring at a plurality of locations to cover a second surface area of the generally horizontal surface of the box-spring and to enable adjustment of the hanging length of said hanging portion of said end panel, said non-slip portion of said end panel being formed as an integral extension of said hanging portion of said end panel, said non-slip portion of said side panel and said hanging portion of said end panel have substantially the same fabric thickness, and said non-slip portion of said end panel being retainable between the mattress and the box-spring only by means of a fabric interaction between a top surface of said non-slip portion of said end panel and the mattress and between a bottom surface of said non-slip portion of said end panel and the box-spring, whereby the first and second surface areas being substantially different from each other such that the first surface area does not substantially overlap the second surface area, the combined surface areas of the first and second surface areas is less than the total surface area of the generally horizontal surface, and said hanging portion of each side panel and each end panel hangs adjacent the box-spring and forms said bed skirt thereon, and wherein said hanging length being adjustable by shifting said non-slip portions of said side and end panels relative to a top surface of the box-spring.

8. A method according to claim 7, said method further comprising the step of:

inserting a non-slip portion of at least one cap including said non-slip portion for said cap and a hanging portion for said cap between the mattress and the box-spring to cover a third surface area of the generally horizontal surface of the box-spring, whereby the first and second surface areas being substantially different from the third surface area such that the first and second surface areas overlap the third surface area and the surface area of each of the first and second surface areas is greater than the surface area of the third surface area, and said hanging portion of each cap hangs adjacent the box-spring and forms said bed skirt thereon.

9. A method according to claim 8, each cap being inserted between the mattress and the box-spring adjacent one of:

inner surfaces of said side panel and said end panel, and outer surfaces of said side panel and said end panel.

10. A method according to claim 7, said method further comprising the step of:

inserting a non-slip portion of at least one cap between the mattress and the box-spring adjacent an edge of the box-spring, whereby the remaining non-inserted portion of each cap hangs adjacent the box-spring and forms said bed skirt thereon.

11. A method according to claim 7, wherein said non-slip and hanging portions of at least one of said side panel and said end panel being formed of a same material.

12. A method according to claim 7, wherein said non-slip and hanging portions of at least one of said side panel and said end panel being formed of different materials.

13. A bed skirt having an adjustable nominal hanging length for use with a bed having at least one mattress on a frame, said bed skirt comprising:

at least one separate side panel including a non-slip portion and a hanging portion, said non-slip portion being formed as an integral extension of said hanging portion and being insertable and retainable between the mattress and the frame at a plurality of locations to cover a first surface area of a generally horizontal surface of the frame and to enable adjustment of the hanging length of said hanging portion, said non-slip portion of said side panel and said hanging portion have substantially the same fabric thickness, and said non-slip portion of said side panel being retainable between the mattress and the frame only by means of a fabric interaction between a top surface of said non-slip portion of said side panel and the mattress and between a bottom surface of said non-slip portion of said side panel and the frame; and at least one separate end panel including a non-slip portion and a hanging portion, said non-slip portion of said end panel being formed as an integral extension of said hanging portion of said end panel and being insertable and retainable between the mattress and the frame at a plurality of locations to cover a second surface area of the generally horizontal surface of the frame and to enable adjustment of the hanging length of said hanging portion of said end panel, said non-slip portion of said end panel and said hanging portion of said end panel have substantially the same fabric thickness, and said non-slip portion of said end panel being retainable between the mattress and the frame only by means of a fabric interaction between a top surface of said non-slip portion of said end panel and the mattress and between a bottom surface of said non-slip portion of said end panel and the frame, wherein when said non-slip portion of each side panel and each end panel is inserted between the mattress and the frame and retained therein, the first and second surface areas being substantially different from each other such that the first surface area does not substantially overlap the second surface area, the combined surface areas of the first and second surface areas is less than the total surface area of the generally horizontal surface, and said hanging portion of each side panel and each end panel hangs adjacent the frame and forms said bed skirt thereon, and wherein said hanging length being adjustable by shifting said non-slip portions of said side and end panels relative to a top surface of the frame.

14. A bed skirt having an adjustable nominal hanging length according to claim 13, further comprising:

at least one separate cap including a non-slip portion and a hanging portion, said non-slip portion of said cap being formed as an extension of said hanging portion of said cap and being insertable between the mattress and the frame to cover a third surface area of the generally horizontal surface of the frame, wherein when said non-slip portion of each cap is inserted between the mattress and the frame and retained therein, the first and second surface areas being substantially different from the third surface area such that the first and second surface areas overlap the third surface area and the surface area of each of the first and second surface areas is greater than the surface area of the third surface area, and said hanging portion of each cap hangs adjacent the frame and forms said bed skirt thereon.

15. A bed skirt having an adjustable nominal hanging length according to claim 14, each cap being disposed adjacent one of:

inner surfaces of said side panel and said end panel, and outer surfaces of said side panel and said end panel.

16. A bed skirt having an adjustable nominal hanging length according to claim 13, further comprising:

at least one cap including a non-slip portion, wherein said non-slip portion of each cap capable of being insertable between the mattress and the frame adjacent edges thereof and retained therein so that the remaining portion of each cap hangs adjacent the frame and forms said bed skirt thereon.

17. A bed skirt having an adjustable nominal hanging length according to claim 13, wherein said non-slip and hanging portions of at least one of said side panel and said end panel being formed of a same material.

18. A bed skirt having an adjustable nominal hanging length according to claim 13, wherein said non-slip and hanging portions of at least one of said side panel and said end panel being formed of different materials.

* * * * *